US012716304B2

(12) United States Patent
Shine, Jr. et al.

(10) Patent No.: US 12,716,304 B2
(45) Date of Patent: Aug. 25, 2026

(54) METHODS FOR ISOLATING A LOST CIRCULATION ZONE IN A CARBONATE SUBSURFACE FORMATION

(71) Applicant: Saudi Arabian Oil Company, Dhahran (SA)

(72) Inventors: Joseph M. Shine, Jr., Houston, TX (US); Maysa S. Al-Ahmadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/010,701

(22) Filed: Jan. 6, 2025

(65) Prior Publication Data

US 2026/0193947 A1 Jul. 9, 2026

(51) Int. Cl.
*E21B 21/00* (2006.01)
*E21B 33/12* (2006.01)

(52) U.S. Cl.
CPC ..... *E21B 21/003* (2013.01); *E21B 33/1208* (2013.01)

(58) Field of Classification Search
CPC .... E21B 21/003; E21B 33/1208; E21B 33/13; E21B 33/16; E21B 33/138; E21B 33/143; C09K 8/50; C09K 8/501; C09K 8/504; C09K 8/5045; C09K 8/516; C09K 8/42; C09K 8/426; C09K 8/424; C09K 8/46; C09K 8/467; C09K 8/487; C09K 8/03
See application file for complete search history.

(56) References Cited

U.S. PATENT DOCUMENTS 3,499,491 A * 3/1970 Wyant ..... C04B 28/26 106/607
5,035,813 A * 7/1991 Shen ..... E21B 33/14 423/230
5,370,185 A * 12/1994 Cowan ..... C09K 8/16 166/293
10,415,330 B2 9/2019 Shine, Jr.
2002/0123433 A1* 9/2002 Goodhue, Jr. ..... C04B 28/26 507/140
2004/0238218 A1* 12/2004 Runia ..... E21B 21/10 175/57
2012/0305248 A1* 12/2012 Ravi ..... C09K 8/06 166/285
2019/0106952 A1* 4/2019 Shine, Jr. ..... E21B 21/003

OTHER PUBLICATIONS

Howard et al., "Squeeze Cementing Operations", Petroleum Transactions, AIME, vol. 189, pp. 53-64, 1950.
Shryock et al., "Problems Related to Squeeze Cementing", Journal of Petroleum Technology, Well Completions, pp. 801-807, Aug. 1968.

* cited by examiner

*Primary Examiner* — Angela M DiTrani Leff
(74) *Attorney, Agent, or Firm* — Dinsmore & Shohl LLP

(57) ABSTRACT

A method of isolating a lost circulation zone in a carbonate subsurface formation comprising pumping a reactive pad fluid into the lost circulation zone, wherein the reactive pad fluid comprises a first aqueous solution, calcium chloride, and sodium montmorillonite; pumping a cement slurry comprising a second aqueous solution and Portland cement into the lost circulation zone via the wellbore to form a cement plug; and isolating the lost circulation zone via the cement plug.

20 Claims, 5 Drawing Sheets

METHODS FOR ISOLATING A LOST CIRCULATION ZONE IN A CARBONATE SUBSURFACE FORMATION

FIELD

The present disclosure relates to natural resource well drilling and to methods for isolating a lost circulation zone in the same. More particularly, it relates to methods for isolating a lost circulation zone in carbonate subsurface formations, as detailed herein.

BACKGROUND

Extracting subterranean fluids may require drilling a hole from the surface to the subterranean geological formation housing the fluids. Specialized drilling techniques and materials are utilized to form the bore hole and extract the fuels. Specialized materials utilized in drilling operations include materials for sealing the casing-casing annulus of the wellbore, which may be formulated for specific downhole conditions.

A wellbore is a hole that extends from the surface to a location below the surface to permit access to subterranean formations. The wellbore contains at least a portion of a fluid conduit that links the interior of the wellbore to the surface. The fluid conduit connecting the interior of the wellbore to the surface may permit access between equipment on the surface and the interior of the wellbore. The fluid conduit may be defined by one or more tubular strings (for example, casings or tubings) inserted into the wellbore and secured in the wellbore.

SUMMARY

However, during drilling of a wellbore lost circulation zones may be encountered and may result in substantial loss of drilling fluid that would otherwise be circulated out of the wellbore or back to surface. In a lost circulation zone, the drilling fluid flows out of the wellbore and into the surrounding subterranean formation. Depending on the severity, the lost circulation zone causes the fluid level in the wellbore to fall below a hydrostatic balanced threshold. Here, the in-situ subterranean formation fluid can flow and breach the surface causing a well control event from a lack of containment. Lost circulation zones result in increased cost of the well to replace the lost fluid while drilling to avoid a loss of containment. Lost circulation zones can also cause a myriad of issues such as pipe sticking, non-circulation of drill bit cuttings out of the wellbore, or collapse of the wellbore in general.

Lost circulation zones can originate from a variety of sources, including but not limited to permeable formations, natural fractures, induced fractures, or vugs. Moreover, the problems associated with lost circulation zones can be especially exacerbated in top-hole sections and/or unconsolidated section of the wellbore, where the increased porosity and permeability makes them particularly susceptible to lost circulation. As used herein, top-hole sections of a wellbore refer to the area of the wellbore nearest the surface at which either the conductor or surface casing is typically placed, typically located between 0 to −4000 feet depth from the surface.

Accordingly, methods and compositions are continually desired by which lost circulation zones may be remediated, isolated, or sealed, especially in top-hole sections, to prevent further fluid loss. One method of reducing fluid loss into lost circulation zones is by introducing a lost circulation material, such as cement, into the wellbore to plug the lost circulation zone, commonly referred to as a cement 'squeeze'. However, conventional cement compositions and placement designs often result in high fluid loss to the formation. Again, this can be exacerbated in top-hole section and/or unconsolidated formations where adherence of the cement in the wellbore architecture can be complicated.

However, the present Inventors have discovered that lost circulation zones in carbonate subsurface formations can be substantially isolated by introducing a reactive pad fluid before introducing a cement composition. Particularly, a calcium chloride component of the reactive pad interacts with the carbonate subsurface formation to liberate at least a portion of magnesium and calcium in the carbonate subsurface formation, forming a reactive formation interface and a supersaturated calcium aqueous phase.

The cement then interacts with the supersaturated calcium aqueous phase to accelerate a precipitation of calcium hydroxide and a hydration of silicates in the cement, thereby transforming the cement to a gel with a porous hydrated silicate matrix. The gelled cement then interacts with the reactive formation interface to immobilize the gelled cement in the carbonate subsurface formation, wherein a sodium montmorillonite component or portion of the reactive pad fluid flocculates and aggregates with the porous hydrated silicate matrix to further increase the gel strength of the cement. This thereby forms a cement plug that may be relatively fixed within the lost circulation zone, isolating the lost circulation zone.

Further yet, it has been discovered that the present reactive pad fluid and cement design is particularly effective in isolating lost circulation zones in top-hole sections or unconsolidated sections of carbonate subsurface formations, as the reactive formation interface is particularly effective in adhering the cement gel between itself and any unconsolidated portions, thereby forming a consolidated cement network and preventing further fluid circulation from washing out or displacing the cement plug.

In at least one embodiment herein, a method of isolating a lost circulation zone in a carbonate subsurface formation may comprise pumping a reactive pad fluid into the lost circulation zone via a wellbore fluidly connected to the carbonate subsurface formation; pumping a cement slurry comprising a second aqueous solution and Portland cement into the lost circulation zone via the wellbore; and isolating the lost circulation zone via the cement plug.

In at least the previous embodiment, the reactive pad fluid comprises a first aqueous solution, calcium chloride, and sodium montmorillonite, the reactive pad fluid interacts with the carbonate subsurface formation to liberate at least a portion of calcium, magnesium, or both in the carbonate subsurface formation, forming a reactive formation interface and a supersaturated calcium aqueous phase, the cement slurry interacts with the supersaturated calcium aqueous phase to accelerate a precipitation of calcium hydroxide and a hydration of silicates in the cement slurry, thereby transforming the cement slurry to a gel with a porous hydrated silicate matrix, the gelled cement slurry interacts with the reactive formation interface to immobilize the gelled cement slurry in the carbonate subsurface formation, and the sodium montmorillonite flocculates and aggregates with the porous hydrated silicate matrix to increase a gel strength of the gelled cement slurry, thereby forming a cement plug.

Additional features and advantages of the described embodiments will be set forth in the detailed description which follows, and in part will be readily apparent to those skilled in the art from that description or recognized by practicing the described embodiments, including the detailed description which follows as well as the claims.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1A:
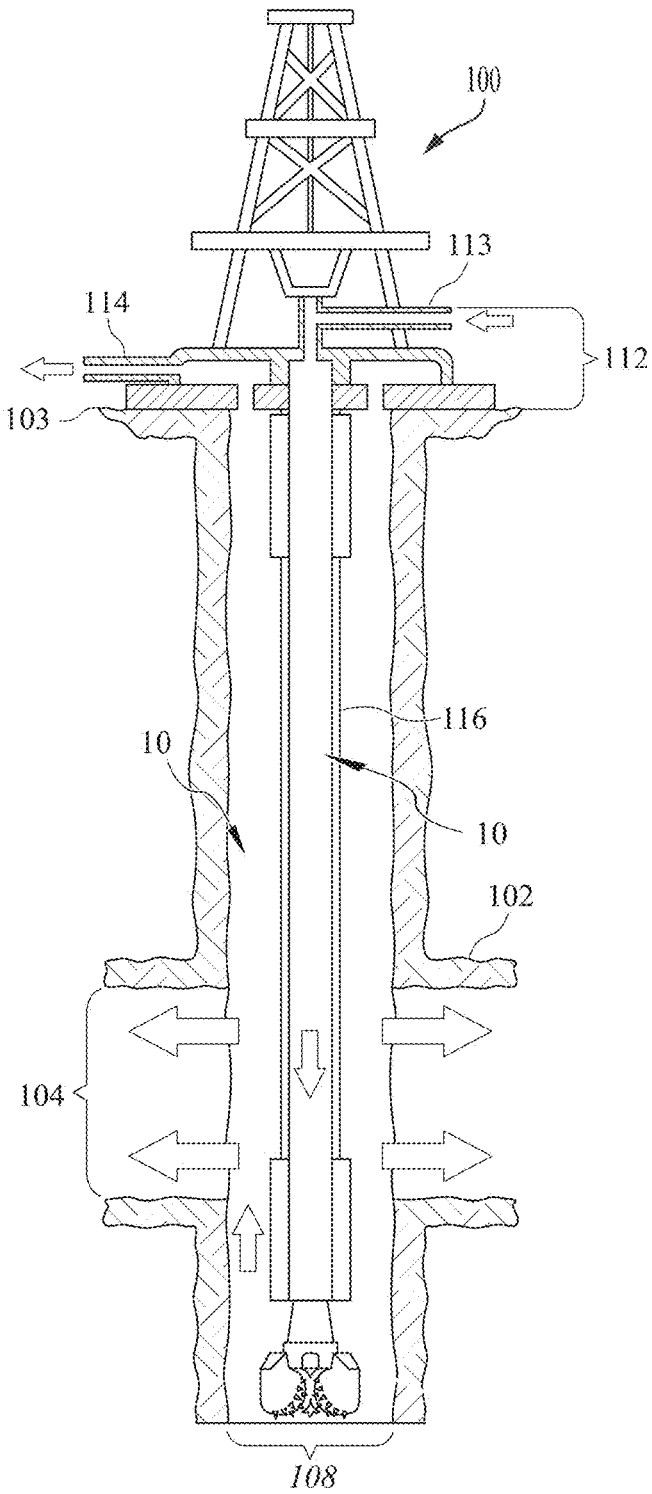
FIG. 1A illustrates a wellbore diagram depicting encountering a lost circulation zone in a carbonate subsurface formation while drilling, according to embodiments herein.

For the purpose of describing the simplified schematic illustrations and descriptions of the relevant figures, the numerous valves, temperature sensors, electronic controllers and the like that may be employed and well known to those of ordinary skill in the art of certain drilling operations may or may not be not included. It should be understood that these components are within the spirit and scope of the present embodiments disclosed. However, operational components, such as those described in the present disclosure, may be added to the embodiments described in this disclosure.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

As previously stated, embodiments herein relate to natural resource well drilling and to methods for isolating a lost circulation zone in the same. More particularly, it relates to methods for isolating a lost circulation zone in carbonate subsurface formations, as detailed herein.

As used throughout this disclosure, the terms "downhole" and "uphole" may refer to a position within a wellbore relative to the surface, with uphole indicating direction or position closer to the surface and downhole referring to direction or position farther away from the surface.

As described in the present disclosure, a "subsurface formation" may refer to a body of rock that is sufficiently distinctive and continuous from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used throughout this disclosure, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used throughout this disclosure, a "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, so as to prevent such interactions. The wellbore wall may also define the void volume of the wellbore.

Referring initially to FIGS. 1A-2B, illustrated are wellbore diagrams illustrating a drilling system 100 for isolating a lost circulation zone 104 in a carbonate subsurface formation 102. As used herein, a carbonate subsurface formation refers to subsurface formations that are predominately limestone ($CaCO_3$) and dolomite ($CaMg(CO_3)_2$), but may also contain amounts of sandstone, siltstone, mudstone, shale, etc. In embodiments, the carbonate subsurface formation 102 may also be unconsolidated. The carbonate subsurface formation 102 may also be a land or offshore (below a surface water body) subsurface formation.

Figure 1B:
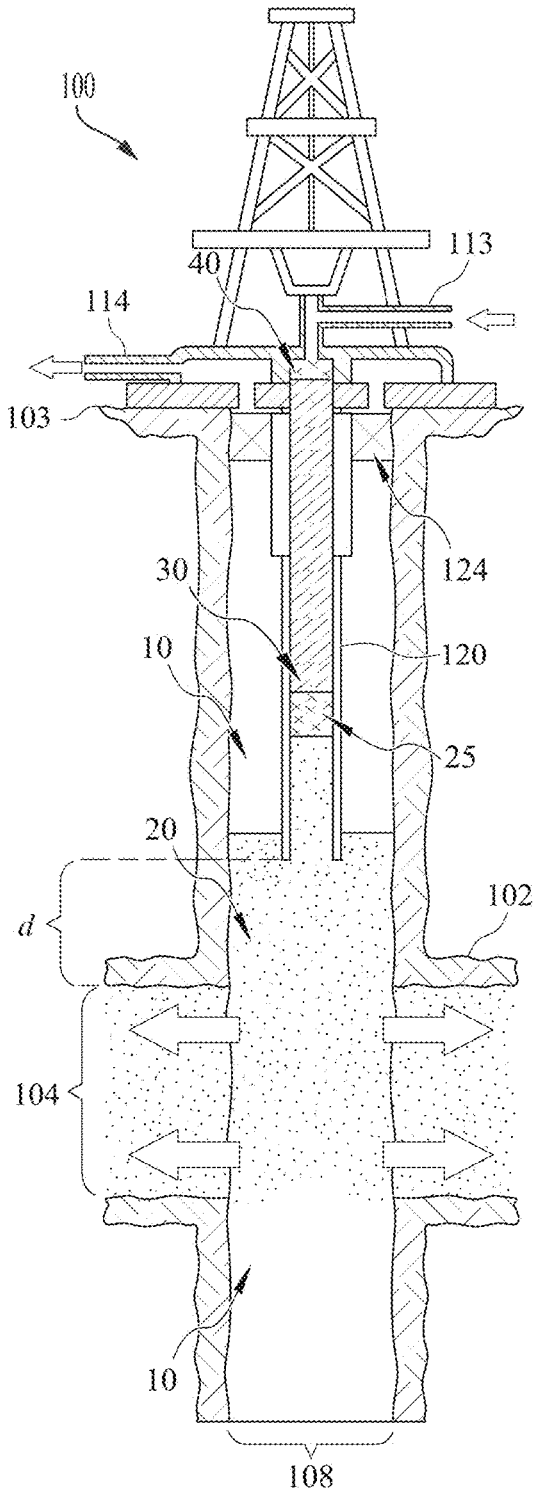
FIG. 1B illustrates the wellbore diagram of FIG. 1A, now depicting introducing the reactive pad to the lost-circulation zone, according to embodiments herein.
Figure 1C:
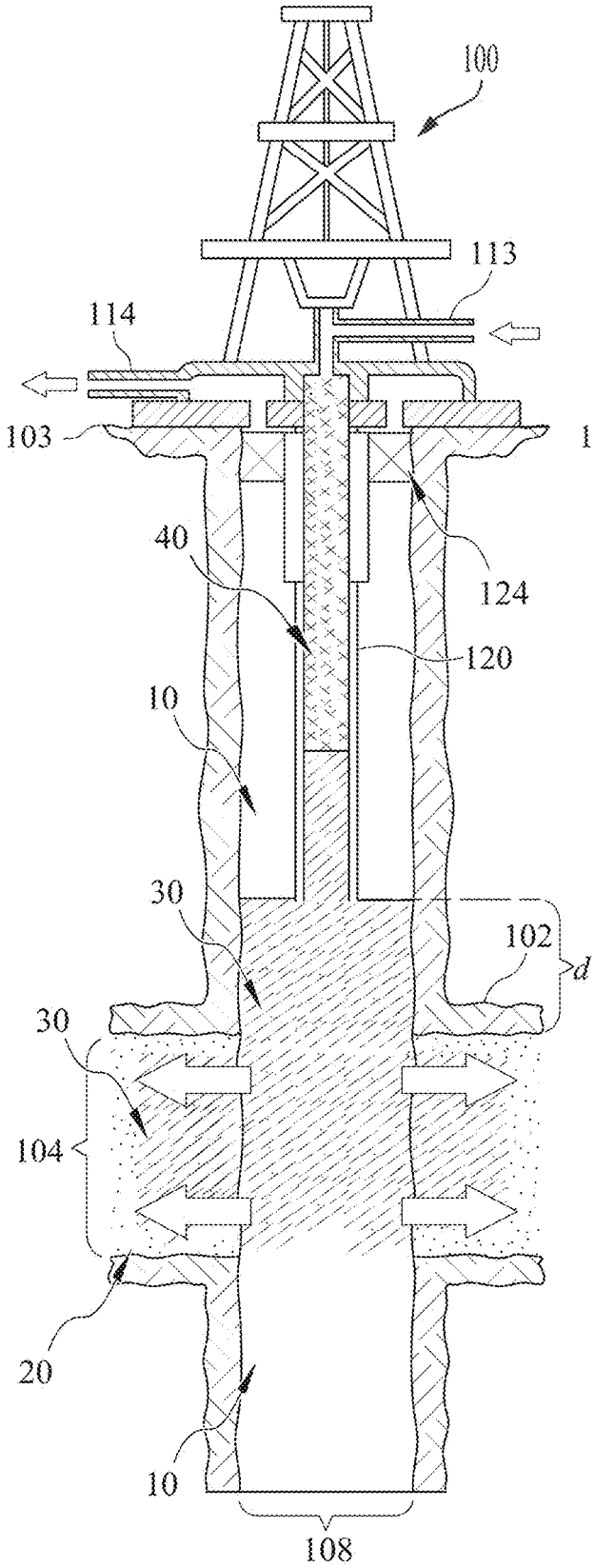
FIG. 1C illustrates the wellbore diagram of FIGS. 1A-1B, now depicting introducing the cement slurry to the lost-circulation zone after the reactive pad fluid interacts with the carbonate subsurface formation, according to embodiments herein.
Figure 1D:
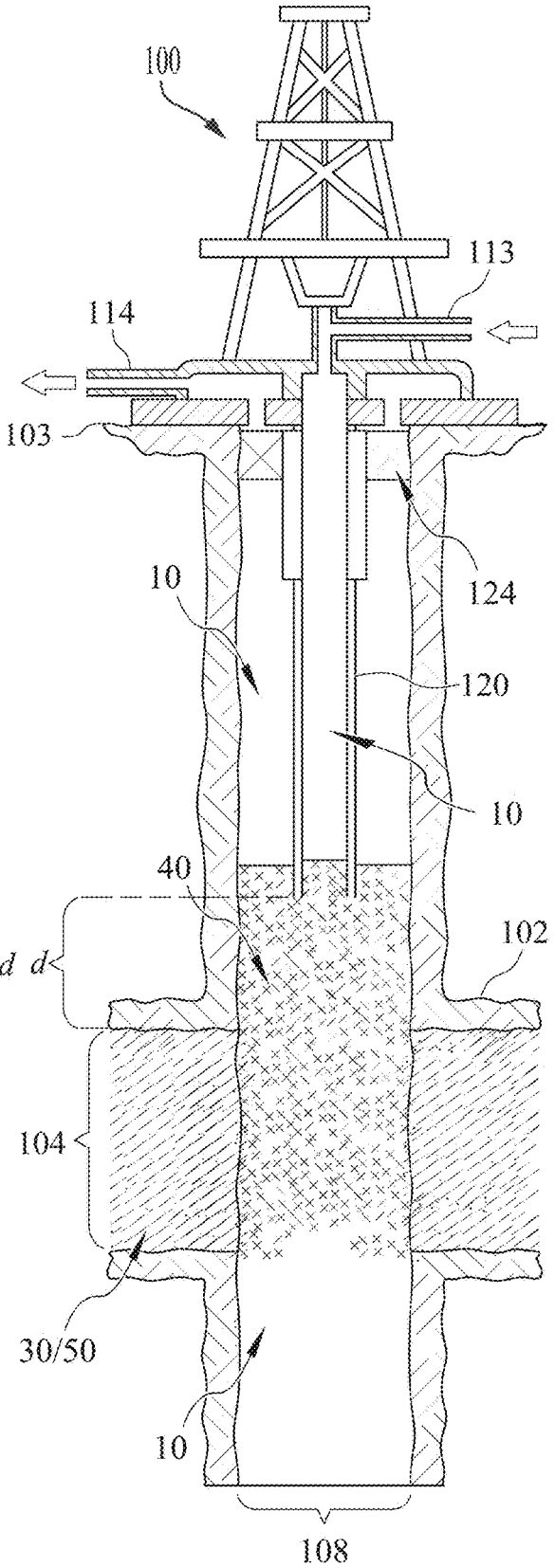
FIG. 1D illustrates the wellbore diagram of FIGS. 1A-1C, now depicting the cement slurry gelling in the lost-circulation zone, as well as introducing the spacer fluid to displace the cement from the wellbore, according to embodiments herein.
Figure 1E:
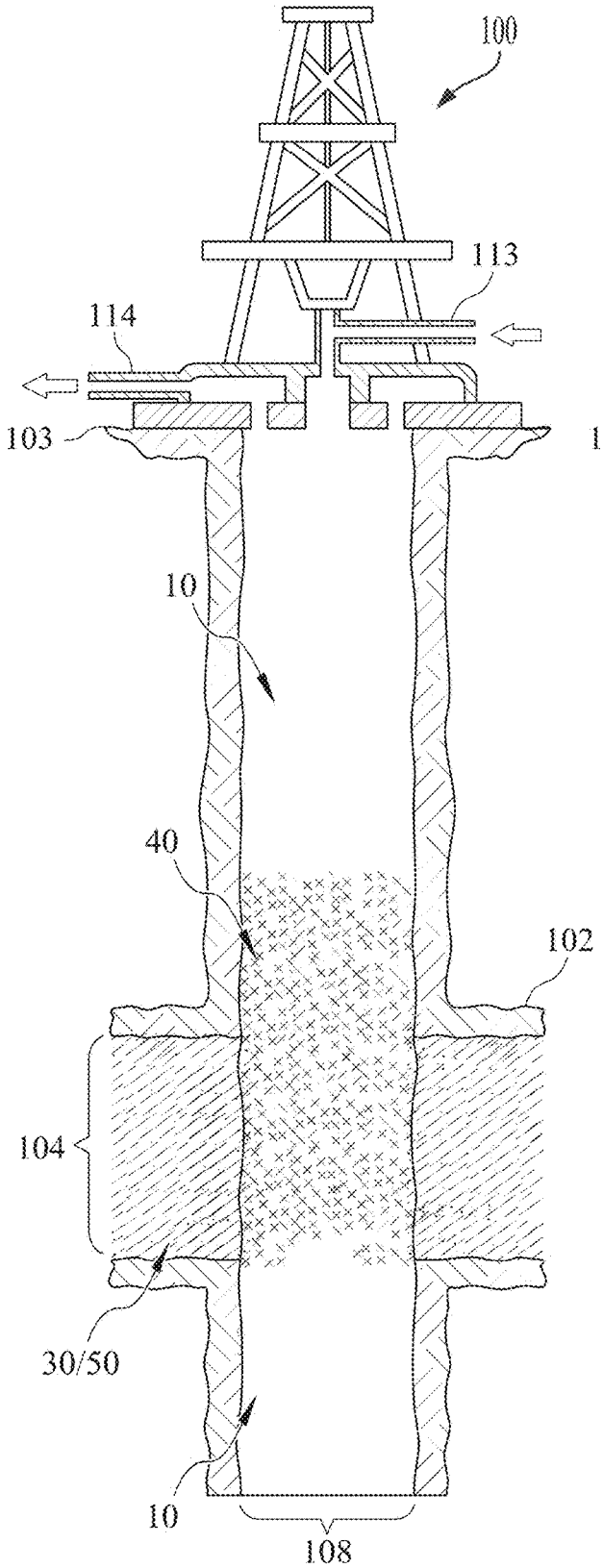
FIG. 1E illustrates the wellbore diagram of FIGS. 1A-1D, now depicting the gelled cement slurry forming the plug in the lost-circulation zone, as well as re-introducing the drilling fluid behind the spacer fluid, according to embodiments herein.
Figure 1F:
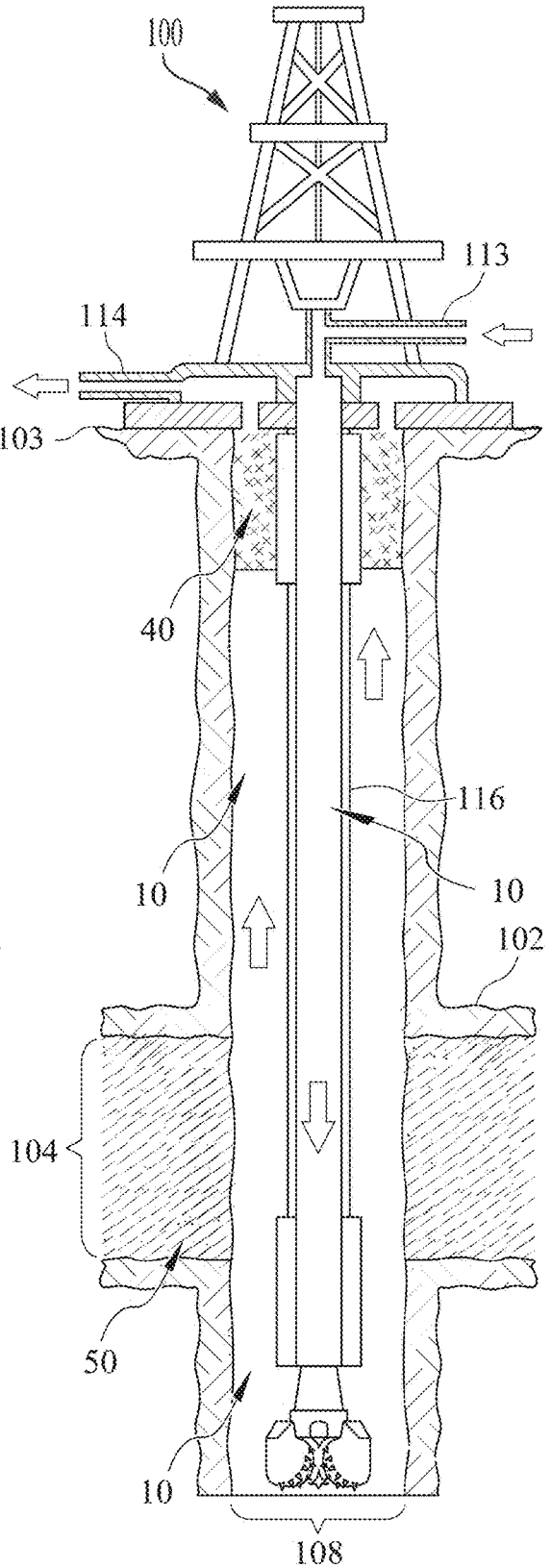
FIG. 1F illustrates the wellbore diagram of FIGS. 1A-1E, now depicting the resuming of drilling operations with an isolated lost circulation zone, as well as the circulation of the spacer fluid back to the surface, according to embodiments herein.
Figure 2A:
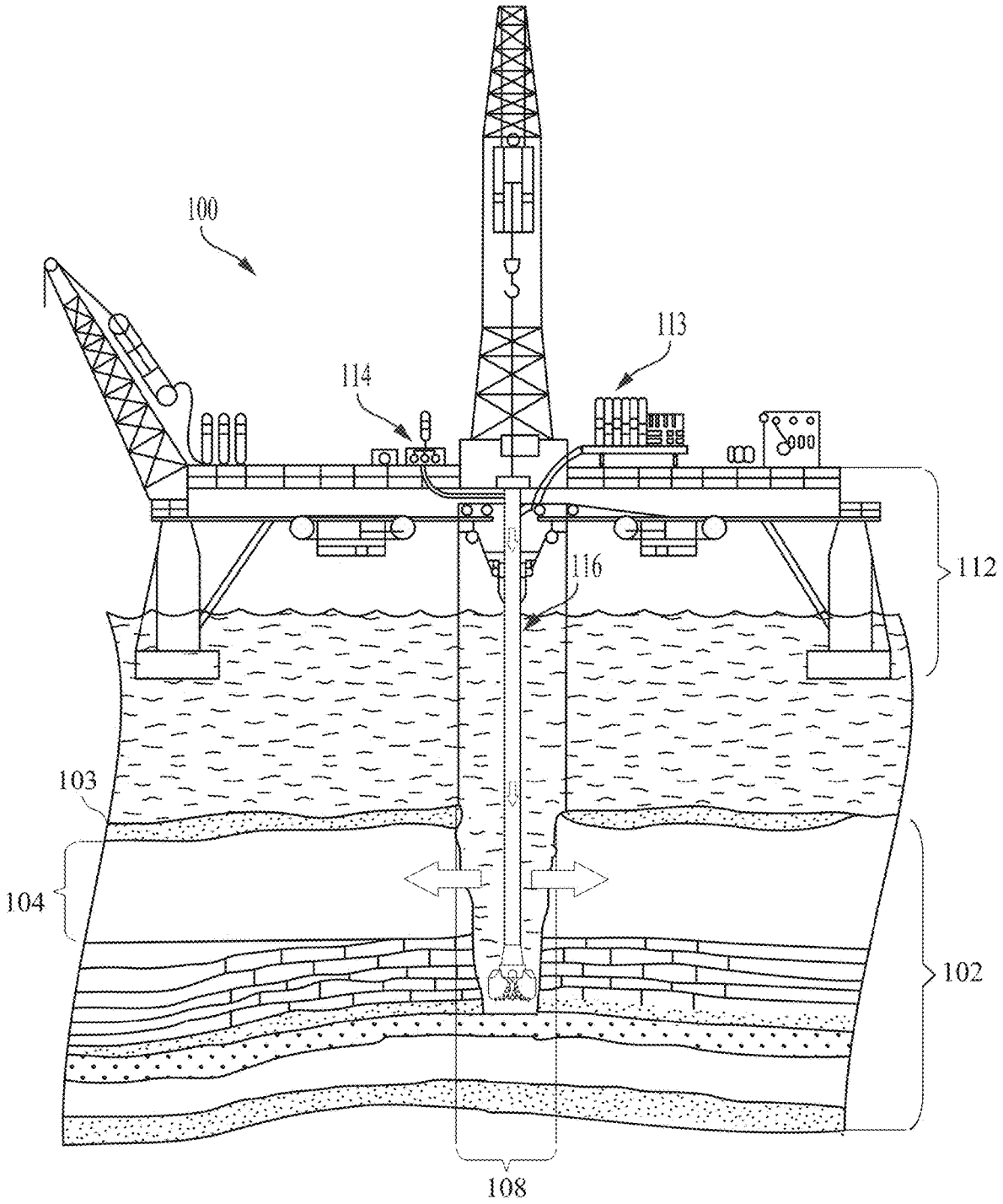
FIG. 2A illustrates a wellbore diagram depicting encountering a lost circulation zone in a carbonate subsurface formation while drilling a top-hole section in an offshore environment, according to embodiments herein.
Figure 2B:
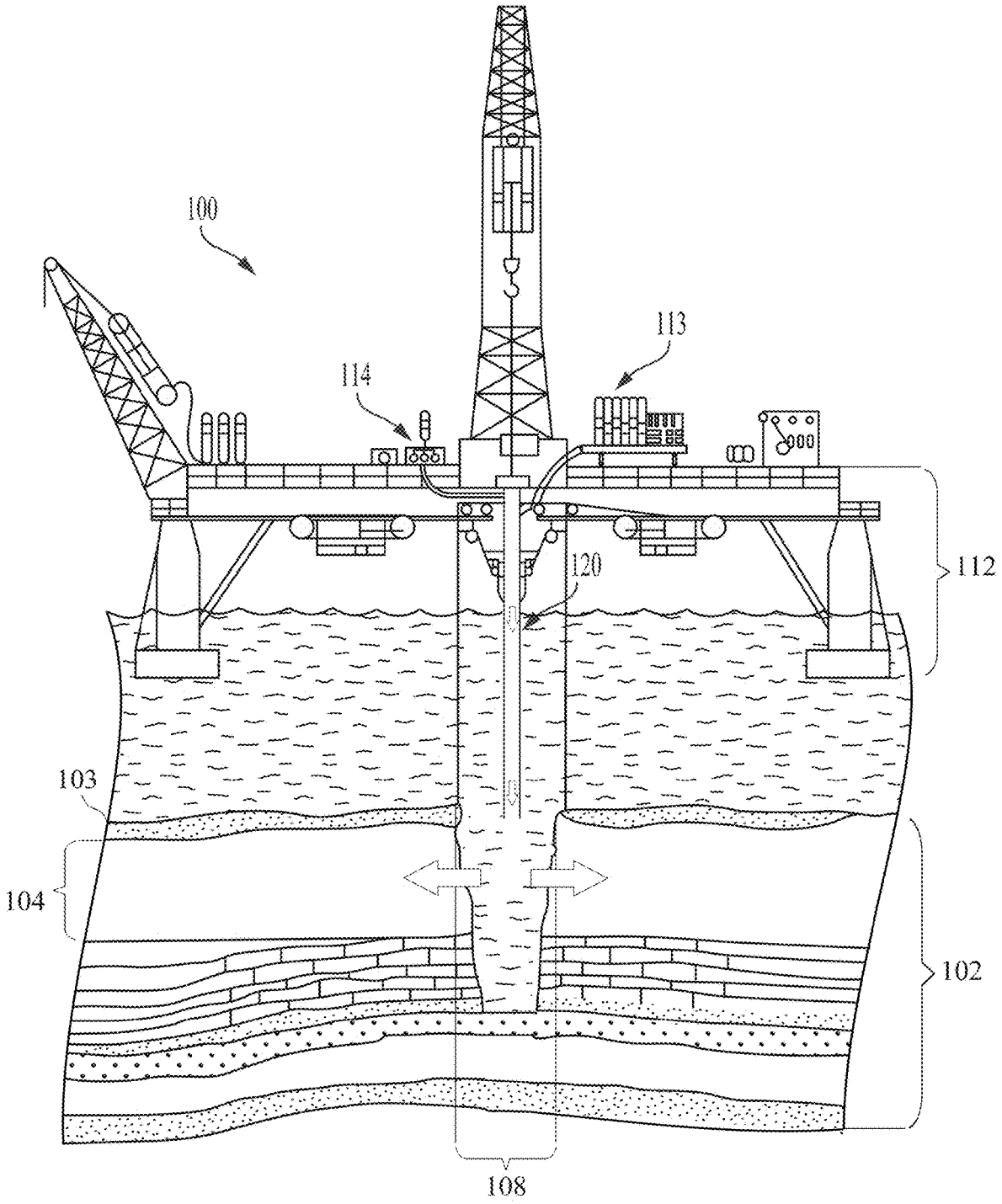
FIG. 2B illustrates the wellbore diagram of FIG. 2A, now depicting the insertion of a conduit to introduce the reactive pad fluid and cement slurry and isolate the lost-circulation zone, according to embodiments herein.

As shown in FIGS. 1A-2B, the drilling system 100 may comprise a drilling platform 112 at or nearby a surface location 103. For example, and as shown in FIGS. 1A-1F, the drilling platform 112 may be positioned at the surface location 103 in the case of a land-based drilling platform 112, i.e. drilling rig. However, as shown in FIGS. 2A-2B, the drilling platform 112 may also be positioned nearby the surface location 103, such as in the case of an offshore drilling platform 112. Accordingly, when the carbonate subsurface formation 102 is an offshore subsurface formation, the drilling platform 112 and thereby the top-hole section of the wellbore 108 may not comprise a riser.

As shown in FIGS. 1A-2B, the drilling system 100 may further comprise a wellbore 108, which may be fluidly connected to the carbonate subsurface formation 102 through the wellbore wall. The wellbore 108 may also form a fluid conduit between the surface location 103 and the carbonate subsurface formation 102.

Still referring to FIGS. 1A-2B, the drilling system 100 may further comprise a drillstem 116 or a conduit 120 positioned within the wellbore 108. Both the drillstem 116 and the conduit 120 may be configured to transmit a fluid from the surface location 103 to the carbonate subsurface formation 102 and/or lost circulation zone 104 through a cavity defined by inner sidewalls of the drillstem 116 or conduit 120.

As previously stated, the drilling system 100 may comprise the drilling platform 112. The drilling platform 112 may further comprise one or more injection lines 113 for introducing the fluid to the drillstem 116 or the conduit 120, as well as one or more return lines 114 for receiving return fluids from the wellbore 108. However, in at least some embodiments the one or more return lines 114 may be sealed, such as via an isolation means 124. In embodiments, the isolation means 124 may be a packer, although the isolation means may alternatively be a valve connected to the one or more return lines 114.

As previously stated, embodiments herein may be related to methods for isolating the lost circulation zone 104 in the carbonate subsurface formation 102. The methods may include any of the drilling systems 100 previously described. For example, the lost circulation zone 104 may occur in a land or offshore carbonate subsurface formation 102. Referring to FIGS. 1A and 2A, the method may comprise drilling through at least a portion of the carbonate subsurface formation 102, such as by utilizing the drillstem 116 and a drilling fluid 10. The method may then comprise encountering the lost circulation zone 104. Without being limited by theory, a determination of whether the lost-circulation zone has been encountered may be made by observing one of a plurality of lost circulation events, such as, but not limited to, a reduction in drilling fluid 10 returns, stuck pipe, or a change in drilling fluid 10 characteristics.

To remedy the lost circulation zone 104, the method may comprise pumping a reactive pad fluid 20 into the lost circulation zone 104, such as via the wellbore 108, as illustrated in FIG. 1B. The reactive pad fluid 20 may comprise a first aqueous solution, calcium chloride, and sodium montmorillonite (also referred to as sodium bentonite). The reactive pad fluid 20 may comprise from 20% to 50% calcium chloride by weight of water (BWOW) and from 10 to 50 pounds per barrel (lbs/bbl) sodium montmorrionite. In embodiments, the first aqueous solution may comprise fresh water, brackish water, seawater, or combinations thereof.

The reactive pad fluid 20 may also comprise a density of from 8.65 pounds per gallon (ppg) to 14.5 ppg, depending on the amount of calcium chloride, sodium montmorillonite, and one or more additional additives. For example, and in embodiments, the reactive pad fluid 20 may further comprise a weighting agent, such as but not limited to calcium carbonate, calcium bromide, or both. As previously stated, the reactive pad fluid 20 may comprise sodium montmorillonite.

In at least some embodiments, the sodium montmorillonite may be pre-hydrated. Without being limited by theory, pre-hydrating the bentonite, such as by adding the bentonite to the first aqueous solution prior to the calcium chloride, may allow for a more effective yielding of the viscosity (viscosity build up) since grades of bentonite may vary (some bentonites may be of lower purity which requires longer times to build the viscosity targets).

The sodium montmorillonite may also have a yield point to plastic viscosity ratio of less than or equal to 1.5, such as from 0.1 to 1.5; a dispersed plastic viscosity of greater than 10 milliPascal seconds (mPa*s), such as from 10 mPa*s to 100 mPa*s; and a 200-mesh screen residue of less than or equal to 2.5 wt. %, such as from 0.001 wt. % to 2.5 wt. %.

Without being limited by theory, the reactive pad fluid 20 may interact with the carbonate subsurface formation 102, thereby liberating at least a portion of calcium, magnesium, or both in the carbonate subsurface formation 102 and forming a supersaturated calcium aqueous phase for the reactive pad fluid 20. Moreover, the liberation of the calcium and magnesium species may operate to form a reactive formation interface in the remaining carbonate subsurface formation 102, which may be beneficial in interacting with a cement slurry 30, as explained in further detail herein.

Particularly, without being limited by theory the reactive pad fluid may operate to free, i.e. dissolve, calcium and magnesium salts from the limestone/dolomite complex of the carbonate subsurface formation, thereby transferring the salts to the in-situ fluid/reactive pad and forming additional porosity in the limestone/dolomite complex that is subsequently filled by the reactive pad. This additional porosity (due to limestone/dolomite's native pore interconnectivity) adds to the permeability, which aids in the subsequent interactions with the cement slurry 30. Further, the absence of these salts forms a 'fresh' formation face that the cement slurry may adhere to.

Without being limited by theory, and as previously stated, this treatment may have particular synergy in carbonate formations as compared to sandstones due at least to the presence of dissolvable calcium (Ca) and magnesium (Mg) species as well as the greater degree of interconnected pore space usually present in carbonates (owing to Mg—Ca channels forming dolomite in the framework).

To introduce the reactive pad fluid 20 and/or any of the other fluids/slurries described below into the wellbore 108, the conduit 120 may be positioned in the wellbore 108. For example, and in embodiments, the conduit 120 may extend from the surface location 103 to a subsurface location positioned a distance (designated "d" in FIGS. 1B-1D) uphole from the lost circulation zone 104. The distance may be at least 150 feet, such as from 150 feet to 200 feet, from 200 feet to 600 feet, from 600 feet to 1000 feet, from 1000 feet to 4000 feet, or any combination of the previous ranges or smaller ranges therein, such as from 150 feet to 4000 feet uphole from the lost circulation zone 104.

After pumping the reactive pad fluid 20, the method may further comprise pumping a cement slurry 30 into the lost circulation zone 104, such as via the wellbore 108 and/or the conduit 120, as illustrated in FIGS. 1C and 2B. The cement slurry 30 may comprise Portland cement and a second aqueous solution, which may be similar or identical to the first aqueous solution.

In at least some embodiments, the cement slurry 30 may be thixotropic, such that the cement slurry 30 will increase in viscosity with no shear and decrease in viscosity with shear. The thixotropic cement slurry 30 may also have a power law exponent value of less than or equal to 0.3 when the thixotropic cement slurry 30 has a density of greater than 12.69 pounds per gallon (ppg), such as from 12.69 ppg to 100 ppg, as one non-limiting example.

In embodiments, similar to the reactive pad fluid 20, the cement slurry 30 may comprise one or more additional additives. For example, the cement slurry 30 may further comprise a dispersant, an antifoaming agent, a retarder, or combinations thereof.

Without being limited by theory, the cement slurry 30 may interact with the supersaturated calcium aqueous phase of the reactive pad fluid 20, thereby accelerating a precipitation of calcium hydroxide in the Alite phase ($Ca_3SiO_5$) of the cement as well as hydrolysis and subsequent silicate hydration of the cement slurry 30 due to diffusion between the different salt concentrations of the phases. This interaction between the phases may lead to a subsequent gel-phase conversion of the cement slurry 30 while in the lost-circulation zone, forming a porous hydrated silicate matrix. Further yet, the now gelled cement slurry 30 may interact with the reactive formation interface caused by the reactive pad fluid 20 to further immobilize the gelled cement slurry 30 in the carbonate subsurface formation 102.

Finally, the sodium montmorillonite in the reactive pad fluid 20 may flocculate and aggregate within the now porous hydrated silicate matrix of the gelled cement slurry 30. Without being limited by theory, the flocculation and aggregation may lead to additional improvement of the gelled cement slurry state 30, by increasing the gel strength of the same and inducing even further immobilization, such that the gelled cement slurry 30 forms a cement plug 50 isolating the lost circulation zone 104, as shown in FIGS. 1D-1F.

Without being limited by theory, it is contemplated that the cement slurry 30 may gel by contact with the pad fluid. Accordingly, to prevent the cement slurry from prematurely gelling, the method may comprise introducing a first spacer fluid 25 in between pumping the reactive pad fluid and the cement slurry. Further, to prevent the cement slurry 30 from entirely gelling in the conduit 120 and/or wellbore 108, the method may further comprise pumping a second spacer fluid 40 into the conduit 120 after the cement slurry 30 such that the cement slurry 30 clears the conduit 120 or is substantially placed within the lost circulation zone 104, as shown in FIGS. 1C-1E.

After displacing the cement slurry 30 from the conduit 120 and/or substantially placing the cement slurry 30 into the lost circulation zone 104, the method may further comprise removing the conduit 120 from the wellbore 108, as shown in FIG. 1E. The method may then comprise resuming drilling operations, such as by inserting the drill-stem 116 back into the wellbore 108, pumping drilling fluid 10 into the wellbore 108, or both, as shown in FIGS. 1E-1F.

It is contemplated that the initial interactions of the cement slurry 30 with the reactive formation interface and the supersaturated calcium aqueous phase of the reactive pad fluid 20 may be sufficient to immobilize the cement slurry 30, as the cement plug 50, in the lost circulation zone 104, such that the further pumping of the spacer fluid 40 and the drilling fluid 10 may not substantially displace the cement plug 50. However, in at least some embodiments, it may be desired to allow the cement plug 50 to further cure prior to resuming drilling operations. Accordingly, the method may further comprise waiting a period of time before resuming drilling operations, such that the cement plug 50 may cure in place.

As previously stated, the methods herein may find particular suitability towards application in lost circulation zones in top-hole sections of the wellbore 108 or unconsolidated sections of the carbonate subsurface formation 102. Accordingly, in at least some embodiments, the carbonate subsurface formation 102, the lost circulation zone 104, or both may be in the top-hole section of the wellbore 108, such that the reactive pad fluid 20, the cement slurry 30, the spacer fluid 40, and the drilling fluid 10 may pumped into the top-hole section of the carbonate subsurface formation 102.

In embodiments, the methods herein may comprise pumping equal parts reactive pad fluid 20 and the cement slurry 30 to the carbonate subsurface formation 102, i.e., equal volumetric amounts reactive pad fluid 20 and cement slurry 30.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

It is also noted that recitations herein of "at least one" component, element, etc., should not be used to create an inference that the alternative use of the articles "a" or "an" should be limited to a single component, element, etc. The singular forms "a," "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising." It is noted that the use of the terms "having" or "including", or grammatical variations thereof, in this disclosure should also be interpreted in like manner as the more commonly used open-ended preamble term "comprising".

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present embodiments herein in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present embodiments including, but not limited to, embodiments defined in the appended claims. More specifically, although some aspects of the present embodiments are identified herein as preferred or particularly advantageous, it is contemplated that the present embodiments is not necessarily limited to these aspects.

What is claimed is:

1. A method of isolating a lost circulation zone in a carbonate subsurface formation, the method comprising:

pumping a reactive pad fluid into the lost circulation zone via a wellbore fluidly connected to the carbonate subsurface formation, wherein:

the reactive pad fluid comprises a first aqueous solution, calcium chloride, and sodium montmorillonite, and the reactive pad fluid interacts with the carbonate subsurface formation to free at least a portion of calcium or calcium and magnesium in the carbonate subsurface formation, forming a reactive formation interface and a supersaturated calcium aqueous phase;

pumping a cement slurry comprising a second aqueous solution and Portland cement into the lost circulation zone via the wellbore, wherein:

the cement slurry interacts with the supersaturated calcium aqueous phase to accelerate a precipitation of calcium hydroxide and a hydration of silicates in the cement slurry, thereby transforming the cement slurry to a gel with a porous hydrated silicate matrix, the gelled cement slurry interacts with the reactive formation interface to immobilize the gelled cement slurry in the carbonate subsurface formation, and the sodium montmorillonite flocculates and aggregates with the porous hydrated silicate matrix to increase a gel strength of the gelled cement slurry, thereby forming a cement plug; and isolating the lost circulation zone via the cement plug.

2. The method of claim 1, wherein the lost circulation zone is in a top-hole section of the wellbore, such that the reactive pad fluid and the cement slurry are pumped into the top-hole section of the carbonate subsurface formation.

3. The method of claim 2, wherein:

the carbonate subsurface formation is an offshore carbonate subsurface formation; and the top-hole section does not comprise a riser.

4. The method of claim 1, wherein the carbonate subsurface formation is unconsolidated.

5. The method of claim 1, wherein the reactive pad fluid comprises:

from 20% to 50% calcium chloride by weight of water (BWOW); and from 10 to 50 pounds per barrel (lbs/bbl) sodium montmorillonite.

6. The method of claim 1, wherein:

the cement slurry is thixotropic; and the cement slurry comprises a power law exponent value of less than or equal to 0.3 when the cement slurry has a density of greater than 12.69 pounds per gallon (ppg).

7. The method of claim 1, wherein the reactive pad fluid further comprises a weighting agent.

8. The method of claim 7, wherein the weighting agent is calcium carbonate, calcium bromide, or both.

9. The method of claim 1, wherein the reactive pad fluid comprises a density of from 8.65 pounds per gallon (ppg) to 14.5 ppg.

10. The method of claim 1, wherein the sodium montmorillonite is pre-hydrated.

11. The method of claim 1, wherein the sodium montmorillonite comprises:

a yield point to plastic viscosity ratio of less than 1.5;

a dispersed plastic viscosity of from 10 milliPascal seconds (mPa*s) to 100 mPa*s; and a 200-mesh screen residue of less than or equal to 2.5 wt. %.

12. The method of claim 1, wherein the first aqueous solution, the second aqueous solution, or both comprise fresh water, brackish water, or seawater.

13. The method of claim 1, in which the cement slurry further comprises a dispersant, an antifoaming agent, a retarder, or combinations thereof.

14. The method of claim 1, wherein equal parts of the reactive pad fluid and the cement slurry are pumped to the carbonate subsurface formation.

15. The method of claim 1, further comprising:

drilling through at least a portion of the carbonate subsurface formation; and encountering the lost circulation zone prior to pumping the reactive pad fluid.

16. The method of claim 1, further comprising introducing a first spacer fluid into the lost circulation zone via the wellbore between pumping the reactive pad fluid and pumping the cement slurry.

17. The method of claim 1, wherein the reactive pad fluid and the cement slurry are introduced to the carbonate subsurface formation via a conduit positioned within the wellbore, the conduit extending from a surface location to a subsurface location located at least 150 feet uphole from the lost circulation zone.

18. The method of claim 17, further comprising pumping a spacer fluid into the conduit after pumping the cement slurry, such that the cement slurry clears the conduit.

19. The method of claim 18, further comprising removing the conduit from the wellbore after the cement slurry clears the conduit.

20. The method of claim 19, further comprising waiting a period of time between the cement slurry clearing the conduit and resuming of drilling operations, such that the cement plug may cure.

* * * * *